US010707617B2

(12) United States Patent
Hirota

(10) Patent No.: US 10,707,617 B2
(45) Date of Patent: Jul. 7, 2020

(54) CONNECTOR

(71) Applicant: Sumitomo Wiring Systems, Ltd., Yokkaichi, Mie (JP)

(72) Inventor: Masanori Hirota, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/425,994

(22) Filed: May 30, 2019

(65) Prior Publication Data

US 2019/0372269 A1 Dec. 5, 2019

(30) Foreign Application Priority Data

Jun. 1, 2018 (JP) ..... 2018-105795

(51) Int. Cl.

| | |
|---|---|
| ***H01R 13/631*** | (2006.01) |
| ***H01R 13/453*** | (2006.01) |
| ***H01R 13/627*** | (2006.01) |
| ***H01R 13/52*** | (2006.01) |
| ***H01R 13/506*** | (2006.01) |
| *H01R 107/00* | (2006.01) |

(52) U.S. Cl.

CPC ..... *H01R 13/631* (2013.01); *H01R 13/4538* (2013.01); *H01R 13/506* (2013.01); *H01R 13/5219* (2013.01); *H01R 13/6271* (2013.01); *H01R 2107/00* (2013.01)

(58) Field of Classification Search

CPC ..... H01R 13/4538; H01R 13/4365; H01R 13/631

See application file for complete search history.

(56) References Cited

U.S. PATENT DOCUMENTS 6,623,285 B2 * 9/2003 Nishide ..... H01R 13/62933 439/140
6,626,702 B2 * 9/2003 Kurimoto ..... H01R 13/4364 439/595
6,692,274 B2 * 2/2004 Maegawa ..... H01R 13/62933 439/157
6,786,768 B2 * 9/2004 Murakami ..... H01R 13/4365 439/271

(Continued)

FOREIGN PATENT DOCUMENTS

JP 2017-134981 8/2017

*Primary Examiner* — Ross N Gushi

(74) *Attorney, Agent, or Firm* — Gerald E. Hespos; Michael J. Porco; Matthew T. Hespos

(57) ABSTRACT

A moving plate (13) is inserted into a receptacle (11) of a connector body (12) and movable between a partial locking position and a connection position and includes partial locking portions (91) and resilient locking pieces (46). The partial locking portions (91) restrict movement of the moving plate (13) to the connection position. The resilient locking pieces (46) lock to receiving portions (75) of a mating connector (60) and allow movement from the connection position to the partial locking position by being kept locked to the receiving portions (75) while separating the mating connector from the receptacle (11). The connector body (12) has restricting surfaces (28) to restrict deflection of the resilient locking pieces (46) until a riding amount of the partial locking portions (91) on second interfering portions (36) is a maximum when the moving plate (13) returns from the connection position to the partial locking position.

5 Claims, 16 Drawing Sheets

(56) References Cited

U.S. PATENT DOCUMENTS 7,114,997 B2 * 10/2006 Sagawa ..... H01R 13/4365 439/752
7,232,323 B2 * 6/2007 Mohs ..... H01R 13/18 439/265
7,267,562 B2 * 9/2007 Katsuma ..... H01R 13/516 439/140
7,476,133 B2 * 1/2009 Tanaka ..... H01R 13/4364 439/752
7,578,709 B2 * 8/2009 Daudin ..... H01R 13/4361 439/752
7,581,969 B2 * 9/2009 Matsushita ..... H01R 13/514 439/140
7,670,177 B2 * 3/2010 Myer ..... H01R 13/4365 439/595
7,722,414 B2 * 5/2010 Tanaka ..... H01R 13/4365 439/595
8,678,865 B2 * 3/2014 Hiraishi ..... H01R 13/4365 439/595
9,755,363 B2 * 9/2017 Suzuki ..... H01R 13/4538
9,793,647 B2 * 10/2017 Suzuki ..... H01R 13/5213
9,972,937 B2 * 5/2018 Akagi ..... H01R 13/62938
10,038,279 B2 * 7/2018 Suzuki ..... H01R 13/631
10,340,621 B2 * 7/2019 Hirota ..... H01R 13/4538
2002/0146281 A1 * 10/2002 Murakami ..... H01R 13/4365 403/326
2006/0205264 A1 * 9/2006 Katsuma ..... H01R 13/516 439/381
2008/0280489 A1 * 11/2008 Tanaka ..... H01R 13/4364 439/598
2017/0214179 A1 * 7/2017 Suzuki ..... H01R 13/4538
2017/0214180 A1 7/2017 Suzuki et al.
2019/0372269 A1 * 12/2019 Hirota ..... H01R 13/6271

* cited by examiner

CONNECTOR

BACKGROUND

Field of the Invention

The invention relates to a connector.

Related Art

Japanese Unexamined Patent Publication No. 2017-134981 discloses a connector with a male housing having a receptacle, a terminal fitting having a tab projecting into the receptacle and a moving plate inserted into the receptacle. The moving plate is movable between an initial position and a connection position backward of the initial position with the tab positioned.

The moving plate is pressed by a female housing of a mating connector that is fit into the receptacle and is moved from the initial position to the connection position. On the other hand, the moving plate is pulled back from the connection position to the initial position when the female housing is separated from the receptacle.

The moving plate includes a holding protrusion and a resilient locking piece projecting forward on a side closer to an end part than the holding protrusion.

The male housing includes an initial position holding projection for restricting a (backward) movement of the moving plate toward the connection position by being locked to the holding protrusion. The female housing includes a locking portion to be locked by the resilient locking piece.

The female housing is inserted into the receptacle during a connecting operation. The resilient locking piece then is locked to the locking portion to restrict rearward displacement of the moving plate relative to the female housing. Further, if the female housing presses the moving plate, the holding protrusion disengages from the initial position holding projection so that the moving plate can move to the connection position.

In separating the connector in the connected state, the female housing is pulled apart from the receptacle. At this time, the resilient locking piece is locked to the locking portion. Thus, the moving plate moves toward the initial position together with the female housing. When the female housing is separated completely, the resilient locking piece is disengaged from the locking portion and the moving plate is stopped at the initial position.

The holding protrusion moves over the initial position holding projection when the moving plate returns from the connection position to the initial position. Thus, resistance is generated to restrict a movement to the initial position. At this time, if a locking force of the resilient locking piece for locking the locking portion is weak, the resilient locking piece may inadvertently disengage from the locking portion before the moving plate returns to the initial position. Thus, the locking force of the resilient locking piece needs to be strengthened. A locking margin of the resilient locking piece with the locking portion could be made larger to enhance the locking force of the resilient locking piece. However, the locking portion, as a locking partner of the resilient locking piece, and a receiving structure of the female housing for receiving the resilient locking piece also become larger. This undesirably reduces a degree of freedom in design and enlarges the entire connector.

The invention was completed on the basis of the above situation and aims to provide a connector capable of ensuring a degree of freedom in design and suppress enlargement.

SUMMARY

A connector of the invention is provided with a connector body including a receptacle, and a terminal fitting with a tab that projects into the receptacle. A moving plate is inserted in the receptacle and positions the tab. The moving plate is movable between a partial locking position and a connection position backward of the partial locking position. The moving plate includes a partial locking portion configured to restrict movement of the moving plate to the connection position by interfering with an interfering portion of the connector body at the partial locking position. However, the partial locking portion moves over the interfering portion when the moving plate returns from the connection position to the partial locking position. A resilient locking piece is configured: to be locked to a receiving portion of a mating connector; to allow a movement from the connection position to the partial locking position by being kept locked to the receiving portion while separating the mating connector from the receptacle; and to release locking to the receiving portion by deforming when the mating connector is separated completely from the receptacle. The connector body has a restricting surface configured to restrict deflection of the resilient locking piece until a riding amount of the partial locking portion on the interfering portion exhibits a maximum value when the moving plate returns from the connection position to the partial locking position.

The partial locking portion rides on the interfering portion while separating the mating connector from the receptacle. The restricting surface of the connector body restricts deflection of the resilient locking piece until the riding amount of the partial locking portion on the interfering portion exhibits the maximum value. Thus, a locking state between the resilient locking piece and the receiving portion is maintained satisfactorily, and the moving plate can reliably return to the partial locking position. The restricting surface of the connector body restricts the deflection of the resilient locking piece. Also, a predetermined locking force is obtained even if a locking margin of the resilient locking piece with the receiving portion is not made larger. As a result, the resilient locking piece need not be enlarged, and the receiving portion of the mating connector also is not enlarged. Therefore, enlargement is suppressed and a degree of freedom in design is ensured.

The connector body may include a prying preventing portion configured to prevent prying of the tab by projecting into the receptacle from a back surface side of the receptacle, and the restricting surface is provided on the prying preventing portion. According to this configuration, the connector body need not have a dedicated structure for the restricting surface and the structure thereof can be simplified.

The mating connector may include a recess configured to receive the prying preventing portion, and the receiving portion may be provided on an inner surface of the recess. Accordingly, the resilient locking piece is not made larger, and the recess need not have a large opening. Thus, structural restrictions around the recess in the mating connector can be reduced.

The connector body may include a housing having the receptacle and a front retainer configured to cover a front surface of the housing by being mounted into the housing. The housing includes a cavity into which the terminal fitting is insertable. A deflectable and deformable locking lance projects into the cavity and is configured to retain the terminal fitting. A rear surface of the front retainer may include a projecting piece configured to restrict deflection of the locking lance and a front surface of the front retainer may include the prying preventing portion. According to this configuration, a function of secondarily retaining the terminal fitting by restricting the deflection of the locking lance, a function of preventing the prying of the tab, and a function of suppressing enlargement by restricting the deflection of the resilient locking piece can be consolidated on the front retainer. Accordingly, structural restrictions of the housing can be reduced.

DETAILED DESCRIPTION

Figure 1:
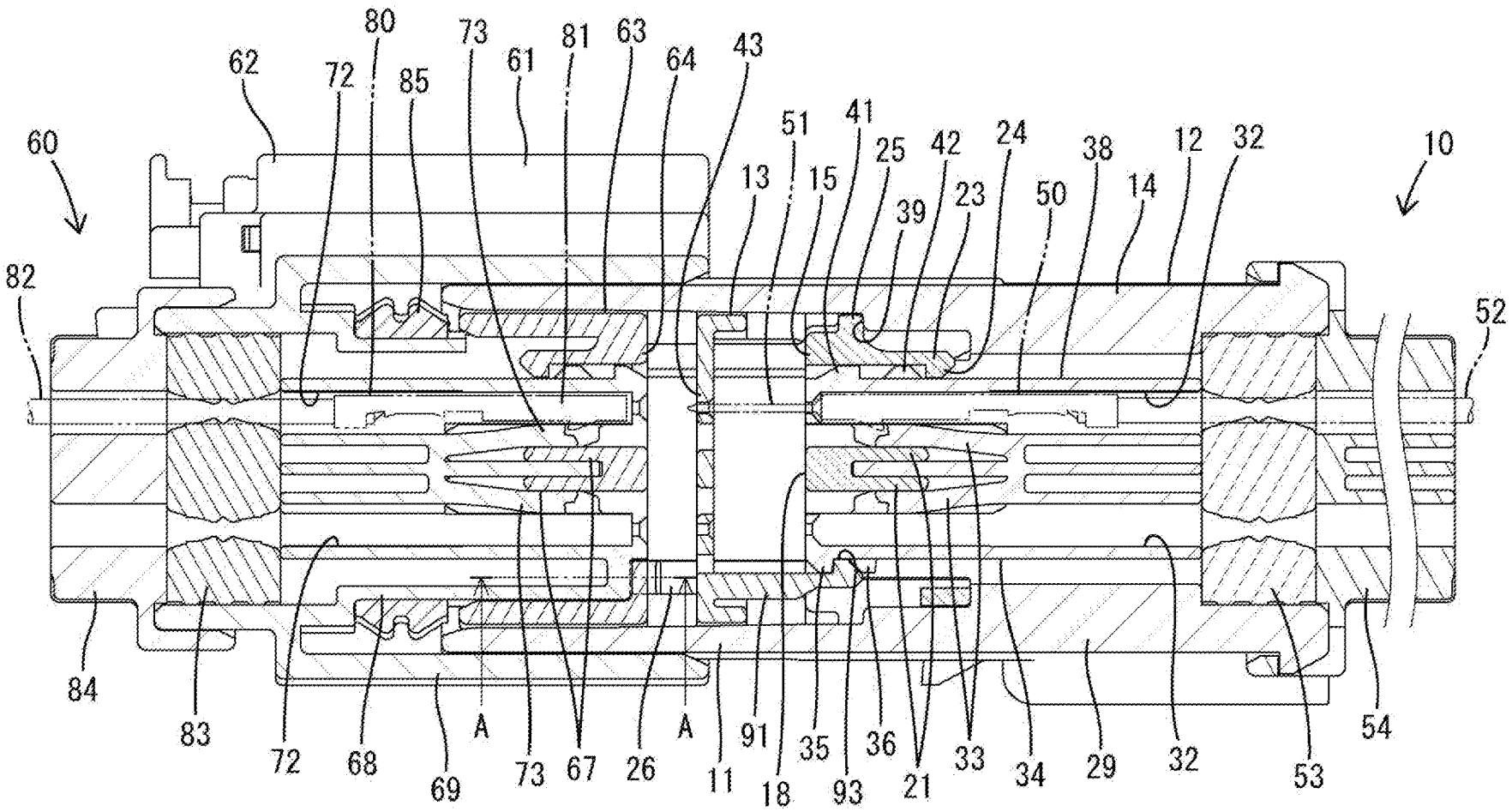
FIG. 1 is a section showing an initial state of inserting a mating connector into a receptacle in one embodiment of the present invention.

An embodiment is described on the basis of the drawings. As shown in FIG. 1, this embodiment is composed of male and female connectors 10, 60 connectable to each other. The male connector 10 includes a connector body 12 having a receptacle 11 and a moving plate 13 arranged movably in the receptacle 11. The female connector 60 is a mating connector and includes a mating connector body 61 having a part fittable into the receptacle 11. In the following description, surface sides of the connectors 10, 60 facing each other at the start of connection are referred to as front ends concerning a front-rear direction and a vertical direction is based on each drawing.

<Female Connector 60>

Figure 15:
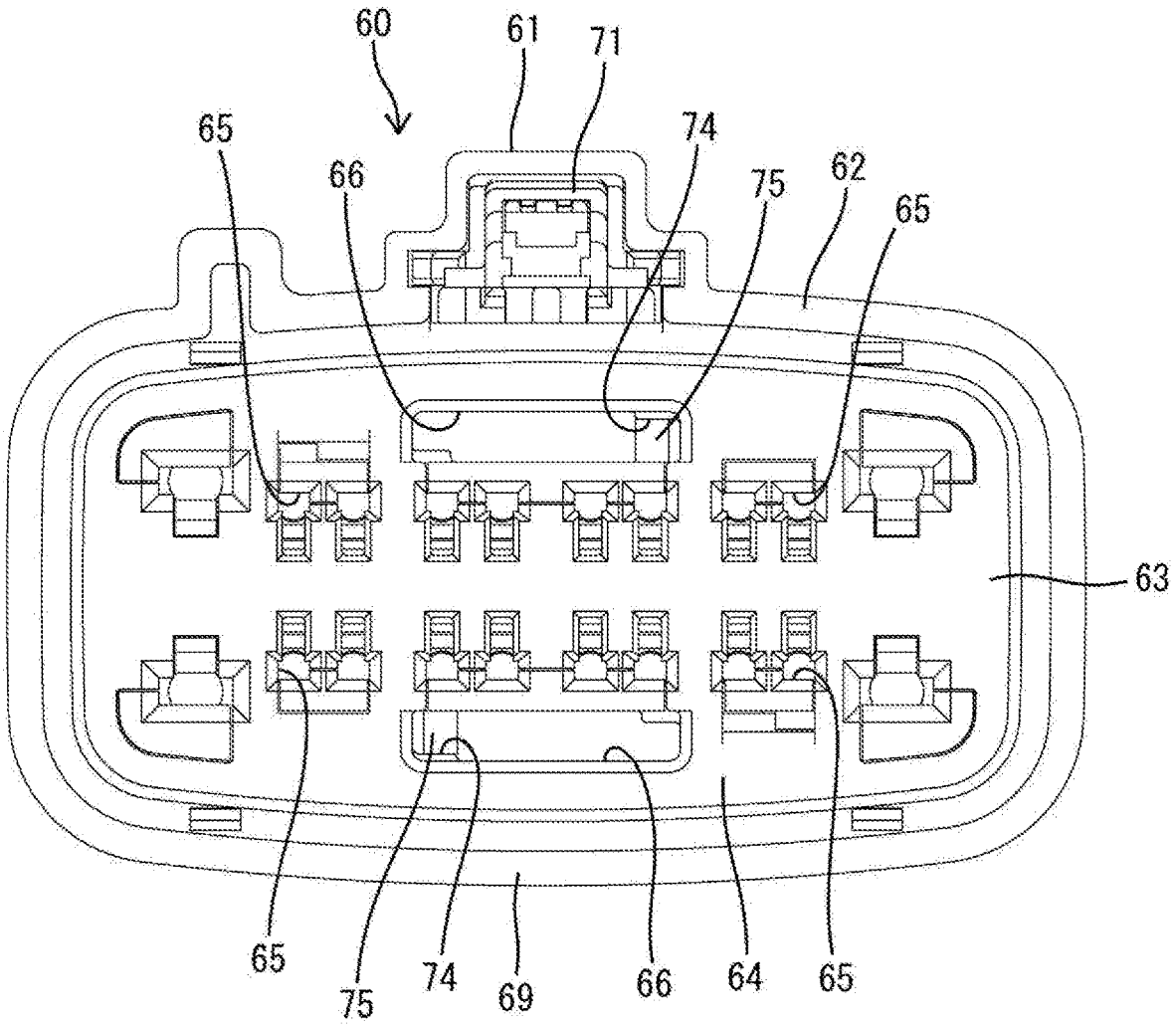
FIG. 15 is a front view of the mating connector.
Figure 16:
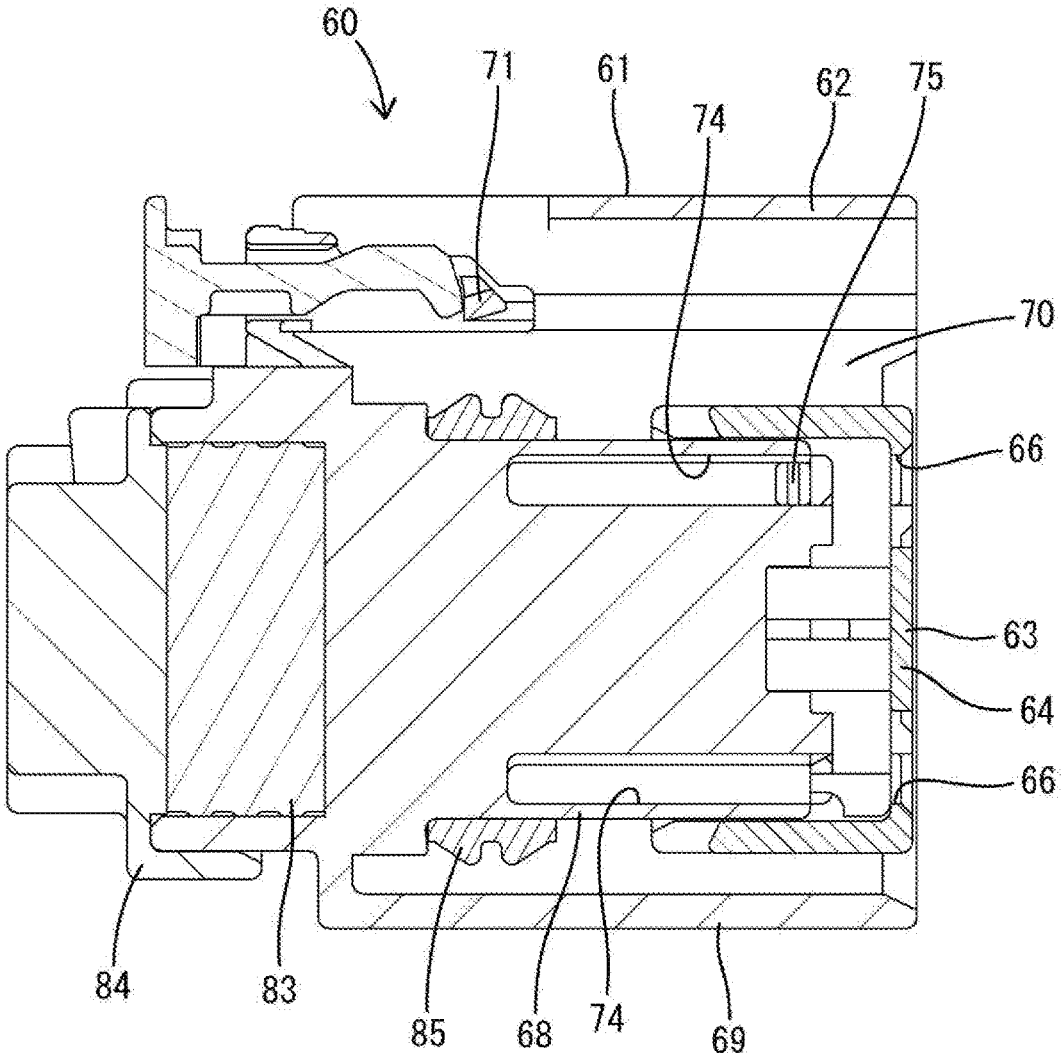
FIG. 16 is a section of the mating connector.

The mating connector body 61 is made of synthetic resin and includes, as shown in FIGS. 15 and 16, a mating housing 62 and a separate mating front retainer 63 to be mounted into the mating housing 62.

The mating front retainer 63 includes a mating front wall 64 for covering the front surface of the mating housing 62. As shown in FIG. 15, the mating front wall 64 includes tab insertion holes 65 into which tabs 51 of terminal fittings 50 to be described later are insertable. The tab insertion holes 65 are aligned laterally in each of two upper and lower rows in the mating front wall 64. The mating front wall 64 includes two through holes 66 on upper and lower sides across an area where the respective tab insertion holes 65 are arranged and in a laterally central part. Each through hole 66 has a laterally elongated opening in the mating front wall 64. As shown in FIG. 1, the mating front wall 64 includes mating projecting pieces 67 projecting rearward at positions corresponding to the respective tab insertion holes 65.

As shown in FIG. 16, the mating housing 62 integrally includes a mating housing body 68 and a fitting tube 69 surrounding the outer periphery of the mating housing body 68. A space between the mating housing body 68 and the fitting tube 69 defines a forwardly open fitting space 70 into which the receptacle 11 can fit. A lock arm 71 projects forward in an area above the fitting space 70. The lock arm 71 resiliently locks a later-described lock 31 of the receptacle 11 to hold the connectors 10, 60 in a connected state.

As shown in FIG. 1, the mating housing body 68 includes mating cavities 72 at positions corresponding to the respective tab insertion holes 65 of the mating front retainer 63, and deflectable mating locking lances 73 project forward at inner walls of the mating cavities 72. The mating locking lances 73 are arranged back to back in the upper and lower mating cavities 72.

A mating terminal fitting 80 is inserted into each mating cavity 72 from behind. The mating terminal fitting 80 is a female terminal fitting and includes a box 81 in a front part and a part to be crimped and connected to a wire 82 in a rear part. The mating locking lance 73 resiliently locks the box 81 for primary retention of the mating terminal fitting 80 in the mating cavity 72. Further, when the mating front retainer 63 is mounted properly into the mating housing 62, the mating projecting pieces 67 enter deflection areas for the mating locking lances 73 to restrict the deflection of the mating locking lances 73 for secondary retention of the mating terminal fittings 80 in the mating cavities 72.

As shown in FIG. 1, a rubber plug 83 is accommodated in a rear part of the mating housing body 68. The rubber plug 83 is held in the mating housing body 68 by a rear holder 84 mounted on the mating housing body 68. The wires 82 connected to the mating terminal fittings 80 are inserted collectively through the rubber plug 83. In this way, sealing is provided between each wire 82 and the mating housing 62 in a liquid-tight manner. Further, a seal ring 85 is fit externally to the mating housing body 68. When the connectors 10, 60 are connected, the seal ring 85 is sandwiched between the mating housing body 68 and the receptacle 11, thereby sealing between the connectors 10, 60 in a liquid-tight manner.

As shown in FIG. 16, the mating housing body 68 includes two recesses 74 at positions corresponding to the respective through holes 66 of the mating front retainer 63, i.e. on both upper and lower sides across an area where the respective mating cavities 72 are arranged and in a laterally central part. Each recess 74 is elongated in the front-rear and lateral directions, and the front end thereof is formed into a slit open in the front surface of the mating housing body 68. The rear end of each recess 74 is located near a center of the mating housing 62 in the front-rear direction, and overlaps an area, where the seal ring 85 is mounted, in the front-rear direction.

Figure 2:
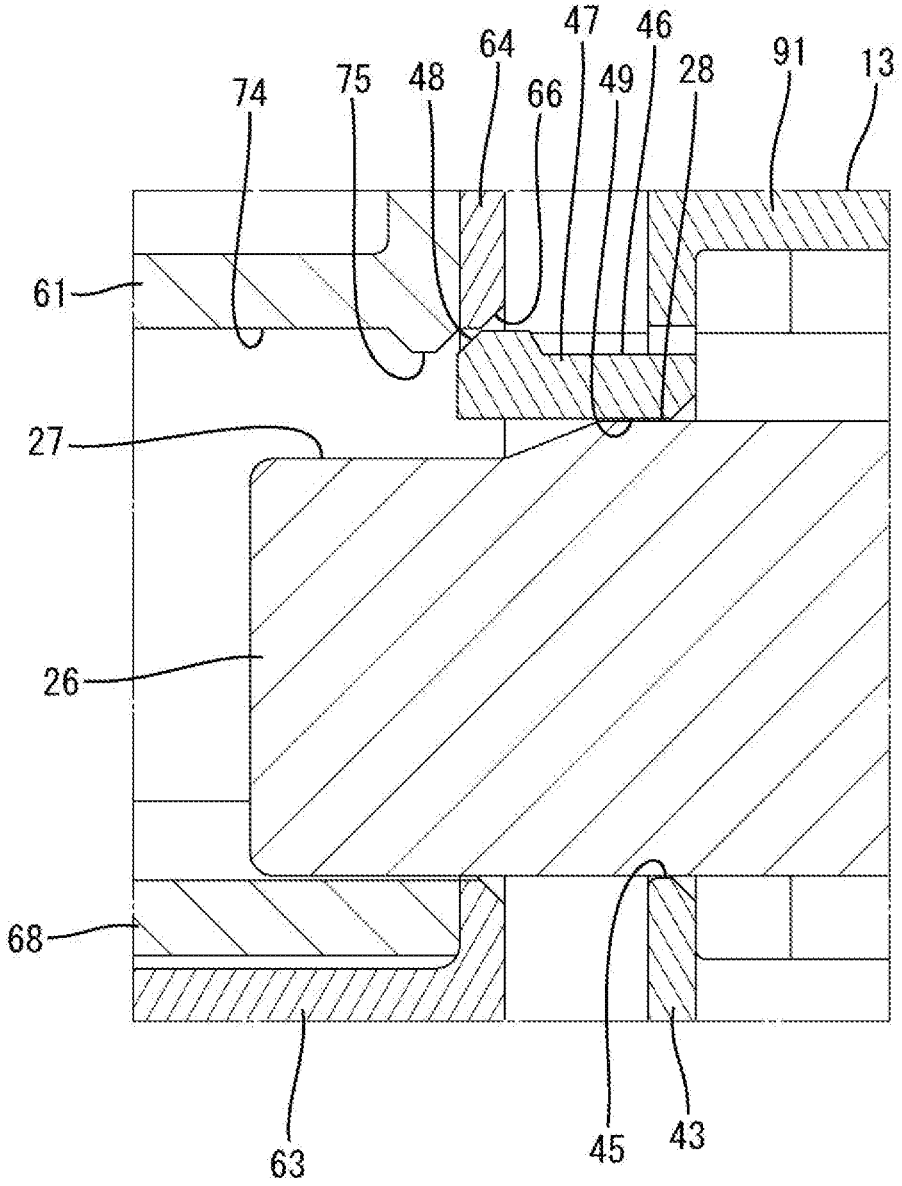
FIG. 2 is a section along A-A of FIG. 1.

As shown in FIG. 15, the upper recess 74 includes a receiving portion 75 projecting in toward a lateral center of the recess 74 on one lateral surface (shown right surface). The lower recess 74 includes a receiving portion 75 projecting in on the other lateral end surface (shown left end surface). The receiving portions 75 are provided at two diagonal positions centered on a central part of the mating housing 62 to fill up upper and lower opening parts of the recesses 74. As shown in FIG. 2, the projecting end surface of the receiving portion 75 is flat in the front-rear direction. The front and rear surfaces of the receiving portion 75 are inclined to taper the receiving portion 75 toward the projecting end surface.

<Male Connector 10>

The connector body 12 is made of synthetic resin and includes, as shown in FIG. 1, a housing 14 and a separate front retainer 15 to be mounted into the housing 14.

Figure 13:
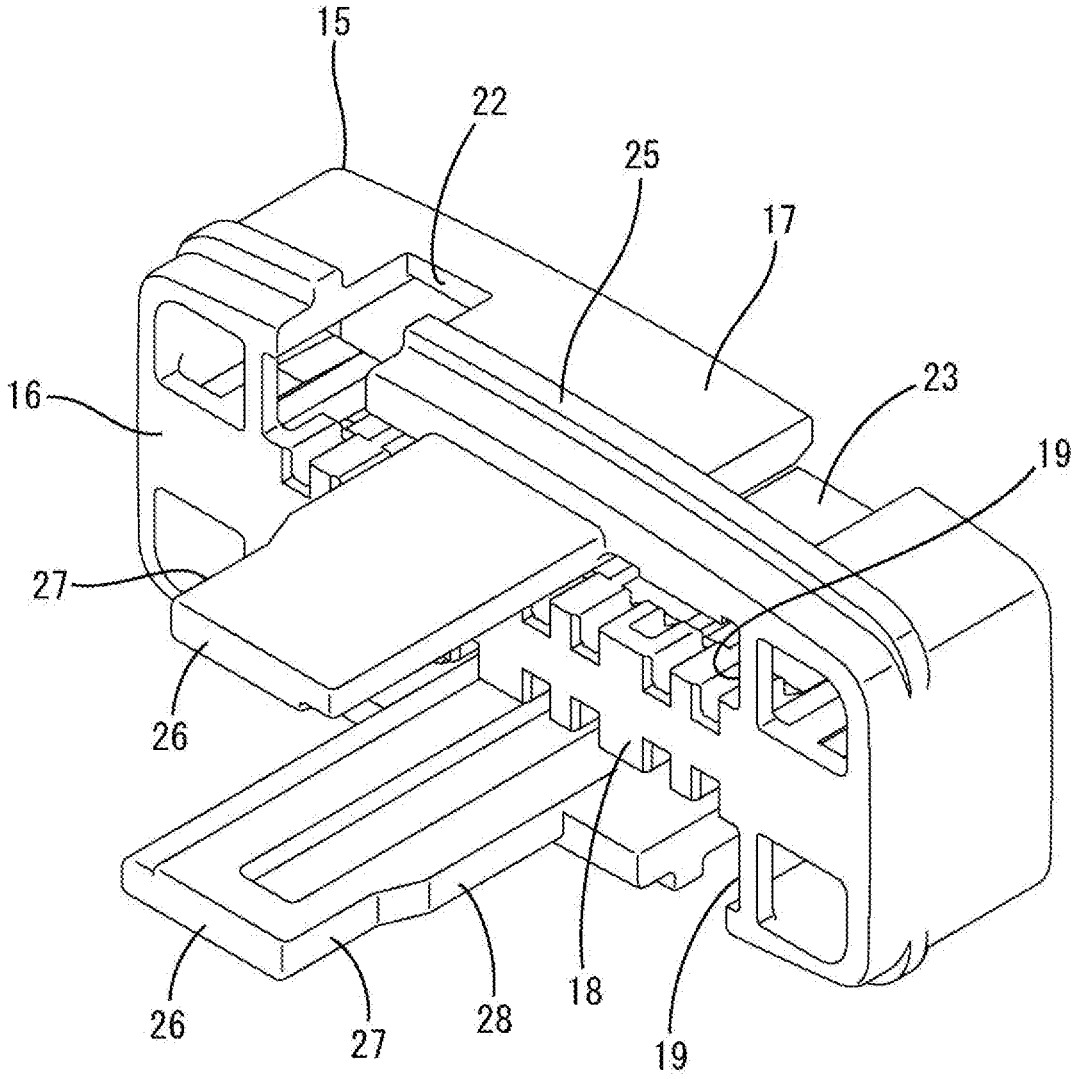
FIG. 13 is a perspective view of a front retainer.
Figure 14:
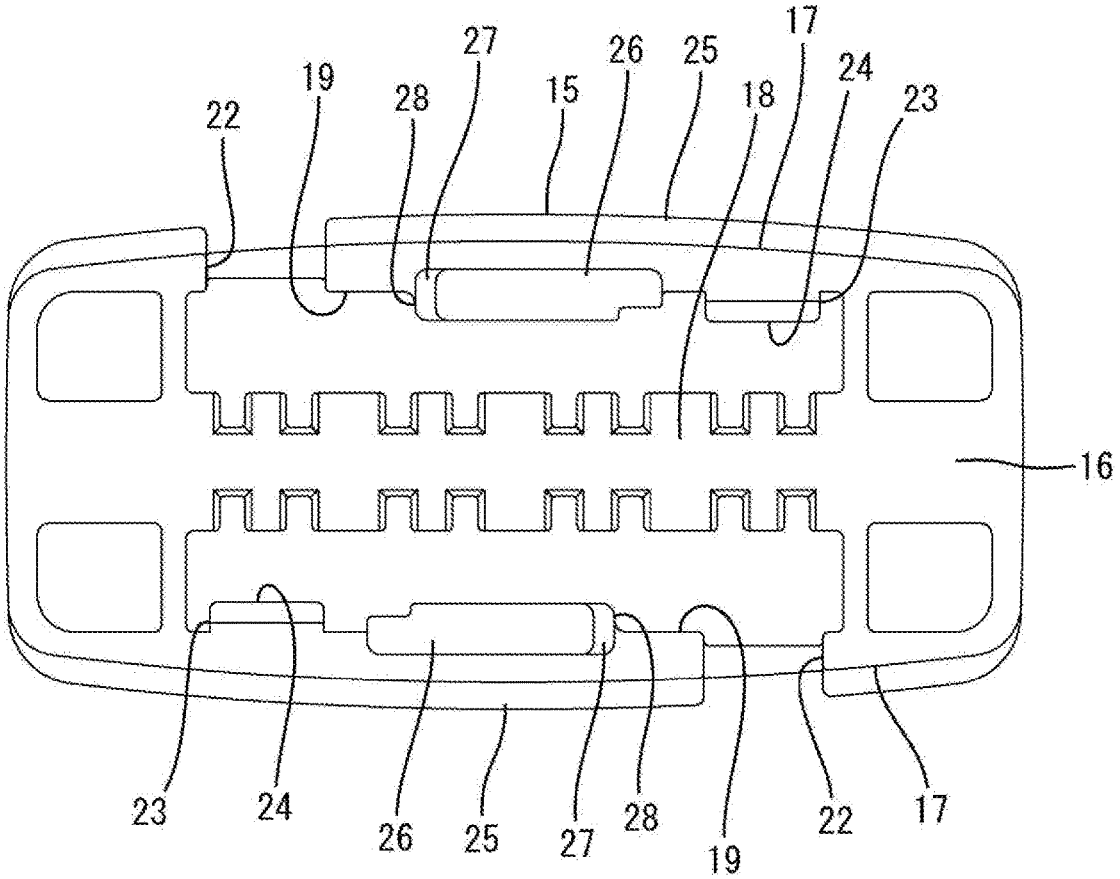
FIG. 14 is a front view of the front retainer.

As shown in FIG. 13, the front retainer 15 includes a front wall 16 for covering the front surface of the housing 14 and a tubular peripheral wall 17 projecting rearward from the outer periphery of the front wall 16. As shown in FIGS. 13 and 14, the front wall 16 includes a beam 18 laterally extending in a vertically central part and two insertion holes 19 extending long in the lateral direction and penetrating in the front-rear direction on both upper and lower sides across the beam 18. As shown in FIG. 1, the beam 18 includes two projecting pieces 21 projecting rearward on the rear surface while being vertically paired.

As shown in FIG. 14, the peripheral wall 17 includes two cutouts 22 extending in the front-rear direction and open in the front surface on one lateral side (shown left side) of an upper surface and the other lateral side (shown right side) of a lower surface part. The cutout 22 is substantially rectangular. Further, the peripheral wall 17 includes plates 23 (see FIG. 13) slightly dropped from upper and lower rear surface parts (parts behind stoppers 25 to be described later) on the other lateral side of the upper surface and the one lateral side of the lower surface, and retainer locks 24 in the form of claws projecting in toward a vertical center on rear parts of the plates 23, as shown in FIG. 14. Further, the peripheral wall 17 includes the rib-like stoppers 25 extending in the lateral direction except at the cutouts 22 on the outer peripheries of the upper and lower surface parts.

As shown in FIGS. 13 and 14, the front retainer 15 includes two prying preventing portions 26 projecting forward on both upper and lower ends near the peripheral wall 17 and in a laterally central part on the front surface. Each prying preventing portion 26 is at a position near the retainer lock 24 in the lateral direction.

Each prying preventing portion 26 is a projecting plate extending in the lateral and front-rear directions, and projects farther in the front-rear direction than a projecting amount of the tab 51 projecting into the receptacle 11. Each prying preventing portion 26 includes an escaping recess 27 in the form of a cutout in one corner of a front end. The escaping recess 27 is formed by recessing one lateral edge in the upper prying preventing portion 26, and by recessing the other lateral end edge in the lower prying preventing portion 26. As shown in FIG. 2, the escaping recess 27 has a forwardly open straight part extending in the front-rear direction and an inclined part inclined rearward from the straight part.

Each prying preventing portion 26 has a restricting surface 28 on a rear surface continuous from the escaping recess 27. As shown in FIG. 14, the restricting surface 28 is formed along the front-rear direction as the one lateral edge in the upper prying preventing portion 26, and is formed along the front-rear direction as the other lateral edge in the lower prying preventing portion 26. Each restricting surface 28 is provided without having a special shape on the side surface of the prying preventing portion 26 on the side of the restricting surface 28, and is substantially parallel to a side surface on a side of the prying preventing portion 26 opposite to the restricting surface 28. In assembling the front retainer 15 with the housing 14, the front retainer 15 can be assembled by pinching the prying preventing portions 26 with fingers to ensure good work efficiency.

Figure 8:
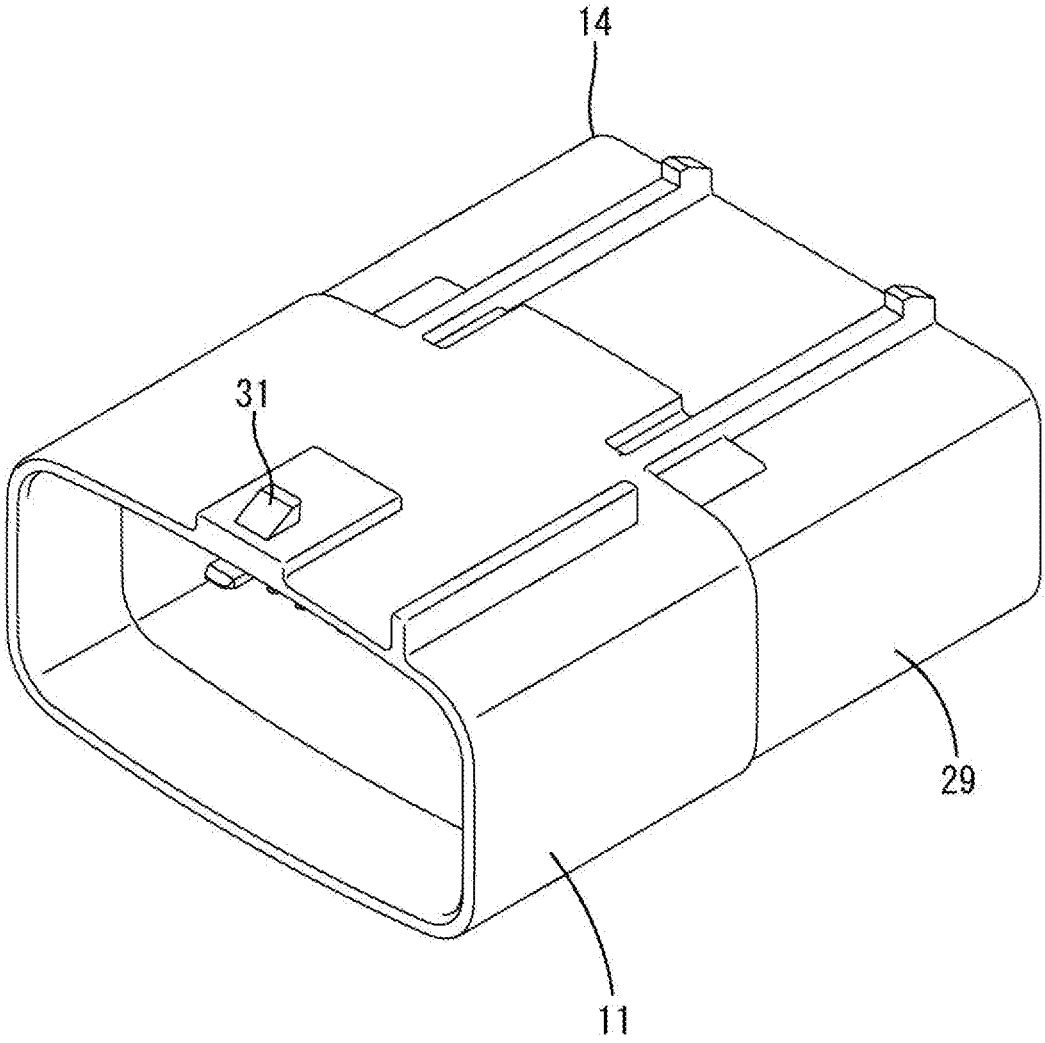
FIG. 8 is a perspective view of a housing.
Figure 9:
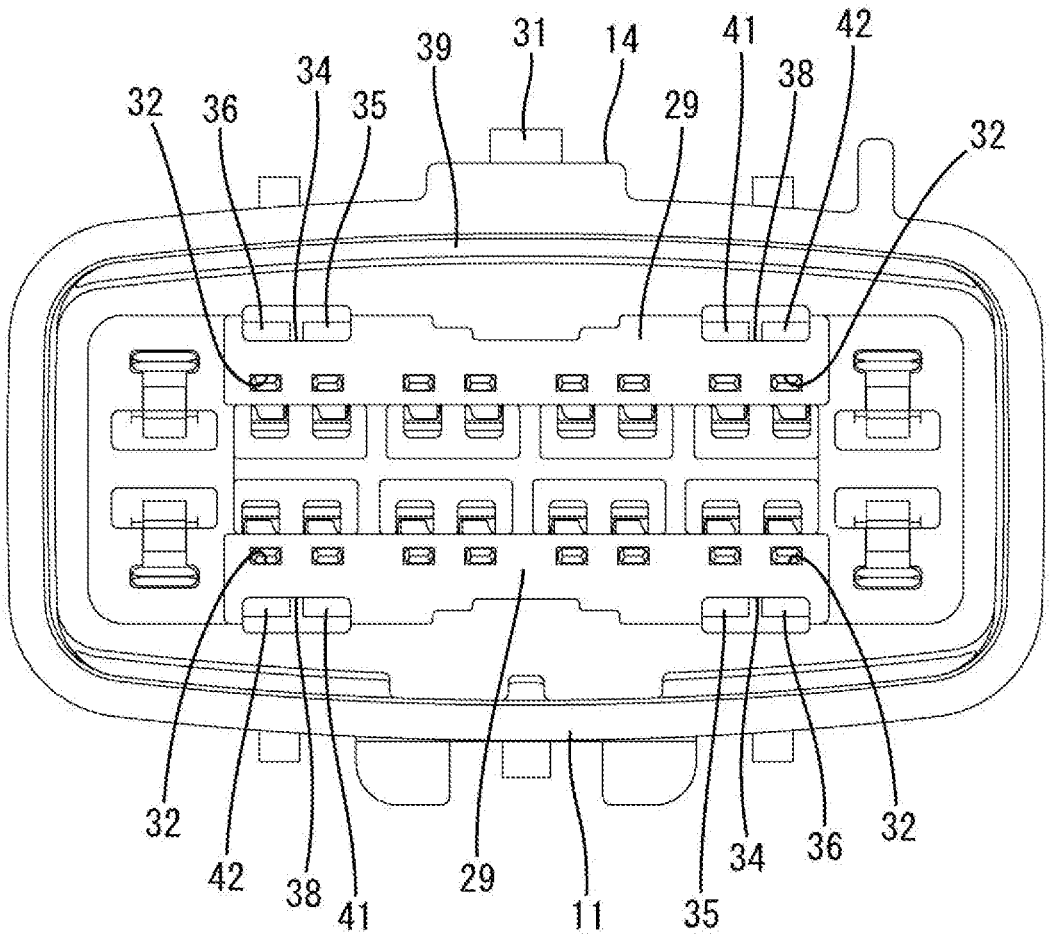
FIG. 9 is a front view of the housing.

As shown in FIGS. 8 and 9, the housing 14 includes a rectangular block-shaped housing body 29 and the tubular receptacle 11 projecting forward from the housing body 29. The receptacle 11 includes the lock 31 in the form of a projection as a locking partner of the lock arm 71 on a front part of an outer surface.

As shown in FIG. 1, the housing body 29 includes cavities 32, and deflectable locking lances 33 project forward on inner walls of the respective cavities 32. The locking lances 33 are arranged back to back in the respective upper and lower cavities 32.

Terminal fittings 50 are inserted into each cavity 32 from behind. Each terminal fitting 50 is a male terminal fitting and includes the tab 51 projecting forward and a part to be crimped and connected to an end part of a later-described wire 52. Each locking lance 33 resiliently locks the terminal fitting 50 for primary retention of the terminal fitting 50 in the cavity 32. Further, when the front retainer 15 is mounted properly into the housing 14, the projecting pieces 21 enter deflection areas for the locking lances 33 to restrict deflection of the locking lances 33 for secondary retention of the terminal fittings 50 in the cavities 32.

As shown in FIG. 1, a rubber plug 53 is accommodated in a rear part of the housing body 29. The rubber plug 53 is held in the housing body 29 by a rear holder 54 mounted on the housing body 29. The wires 52 connected to the respective terminal fittings 50 are inserted collectively inserted through the rubber plug 53. In this way, sealing is provided between each wire 52 and the housing 14 in a liquid-tight manner.

A front part of the housing body 29 is spaced from the receptacle 11 in a circumferential direction and has an outer peripheral surface facing an inner peripheral surface of the receptacle 11. The peripheral wall 17 of the front retainer 15 is fit externally to the front part of the housing body 29. Further, the front part of the housing body 29 is divided into upper and lower sections (see FIG. 9) that are inserted respectively into the insertion holes 19 of the front retainer 15 mounted in the housing 14.

As shown in FIG. 9, the housing body 29 includes two shallow recesses 34 extending in the front-rear direction and open in both front and rear ends in upper and lower parts of the outer peripheral surface of the front part. The recesses 34 are arranged at two diagonal positions centered on a central part of the front surface of the housing body 29. Each recess 34 includes first and second interfering portions 35, 36 inside. The first and second interfering portions 35, 36 are in the form of claws projecting on the bottom surface of the recess 34 and have a projecting amount corresponding to a depth of the recess 34.

Figure 4:
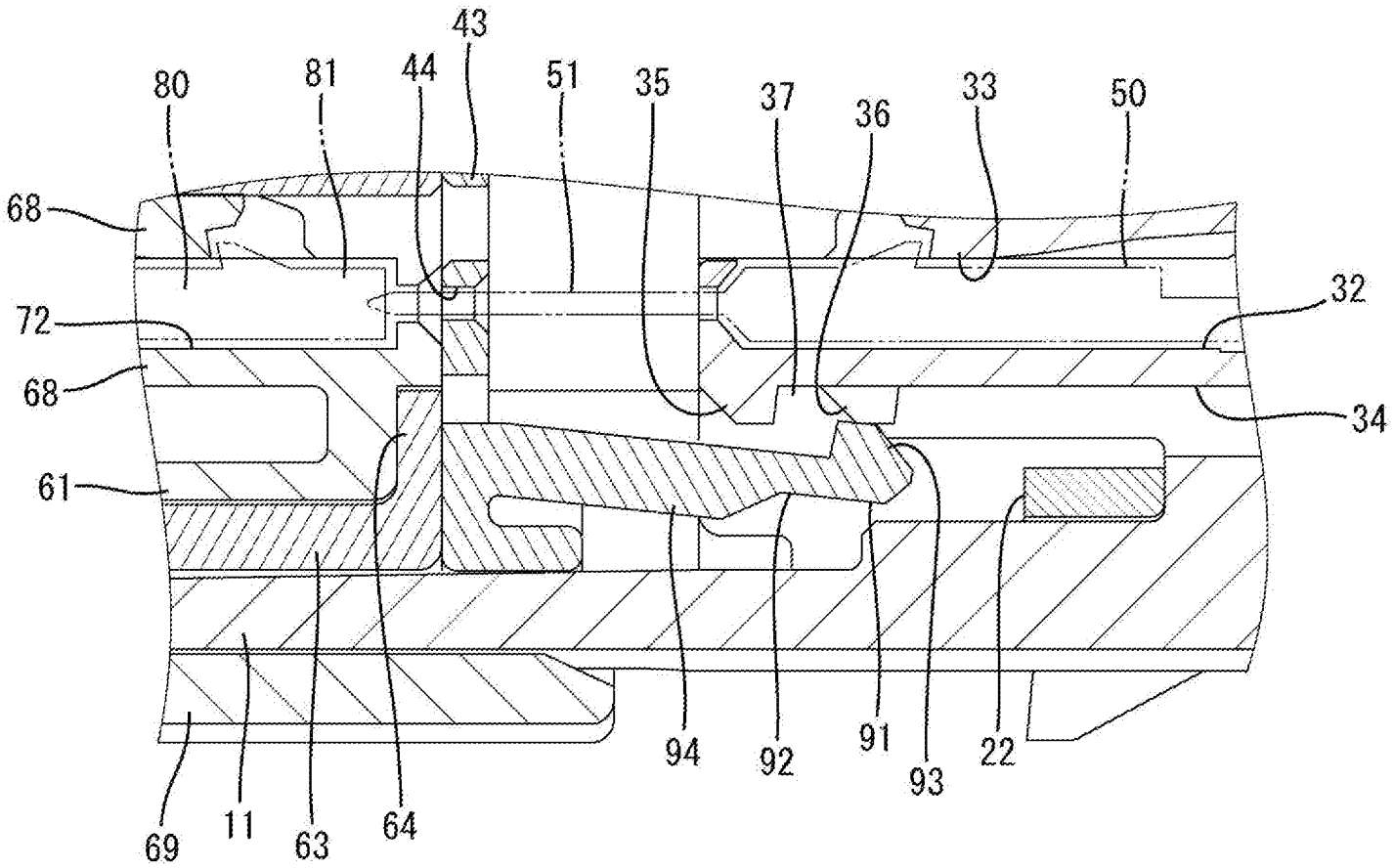
FIG. 4 is an enlarged section showing a state where a partial locking portion is deflected and deformed in the process of connecting/separating the connector in a stage different from that in FIG. 3.

The first and second interfering portions 35, 36 are arranged to deviate from each other in the front-rear and lateral directions. As shown in FIGS. 1 and 4, the first interfering portion 35 is in front of the second interfering portion 36. Further, the front surfaces of the first and second interfering portions 35, 36 are inclined rearward, the rear surfaces thereof are substantially vertically upright, and the projecting end surfaces are flat in the front-rear direction.

Each recess 34 includes a movement restricting space 37 capable of restricting a movement of the moving plate 13 in the front-rear direction between the first and second interfering portions 35, 36.

As shown in FIG. 9, the housing body 29 includes retainer-side recesses 38, formed similarly to the recesses 34, at two diagonal positions in the upper and lower parts of the outer peripheral surface of the front part and on sides opposite to the recesses 34. Each retainer-side recess 38 includes retainer-side first and second interfering portions 41, 42 inside. Similar to the first and second interfering portions 35, 36, the retainer-side first and second interfering portions 41, 42 deviate from each other in the front-rear and lateral directions, but are longer than the first and second interfering portions 35, 36 in the front-rear direction and a separation distance therebetween is longer than that between the first and second interfering portions 35, 36, as shown in FIG. 1.

As shown in FIG. 1, the receptacle 11 has steps 39 facing forward at positions corresponding to the recesses 34 and the retainer-side recesses 38 in the front-rear direction. When the front retainer 15 is mounted properly into the housing 14, the stoppers 25 contact the steps 39 from the front, the plates 23 of the peripheral wall 17 enter the retainer-side recesses 38 and the retainer lock portions 24 resiliently lock the rear surfaces of the retainer-side second interfering portions 42 to restrict a movement of the front retainer 15 in the front-rear direction. Further, although not shown, the retainer locks 24 are sandwiched between the retainer-side first and second interfering portions 41, 42 to keep the front retainer 15 in a partially locking state where deflection of the locking lances 33 is allowed before the terminal fittings 50 are inserted into the cavities 32 of the housing body 29.

As shown in FIG. 1, the moving plate 13 includes a plate body 43 and is inserted into the receptacle 11 with plate surfaces of the plate body 43 facing forward and rearward. When inserted in the receptacle 11, the moving plate 13 is movable in the front-rear direction between a partial locking position (see FIG. 1) where the plate body 43 is separated forward from the back end surface of the receptacle 11 (front wall 16 or the front end of the housing body 20) and a connection position (see FIG. 6) where the plate body 43 contacts the back surface of the receptacle 11.

Figure 10:
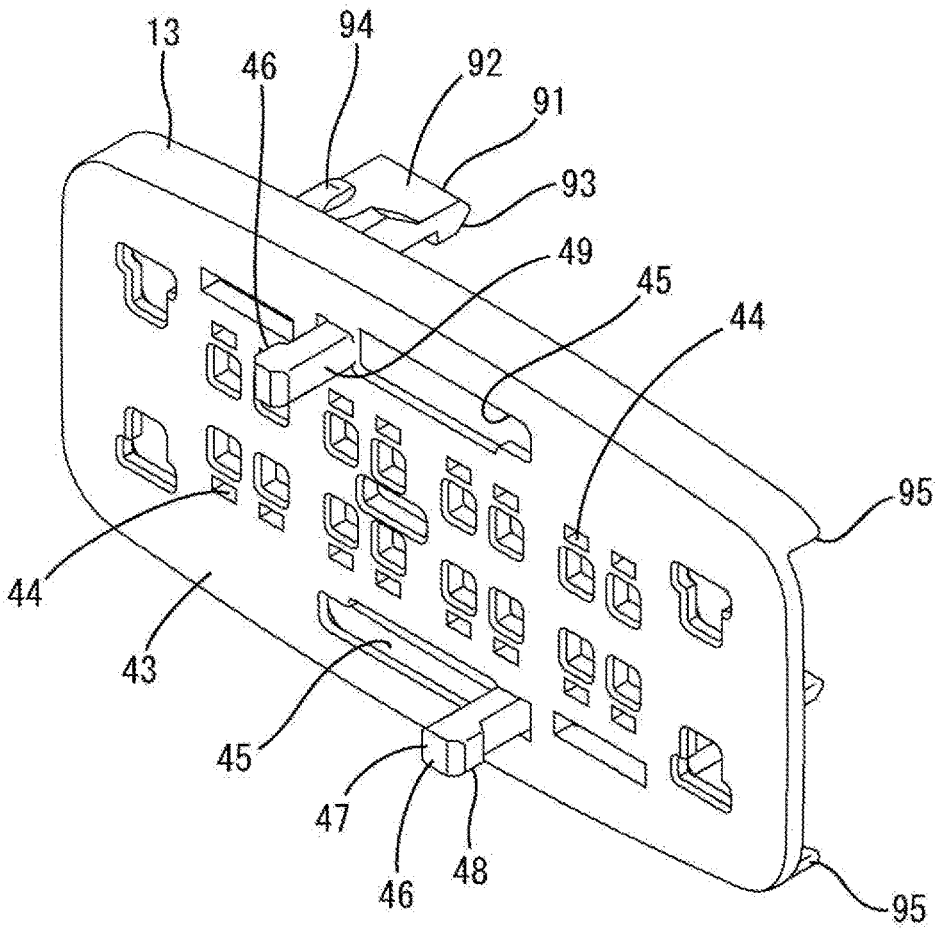
FIG. 10 is a perspective view of a moving plate.
Figure 11:
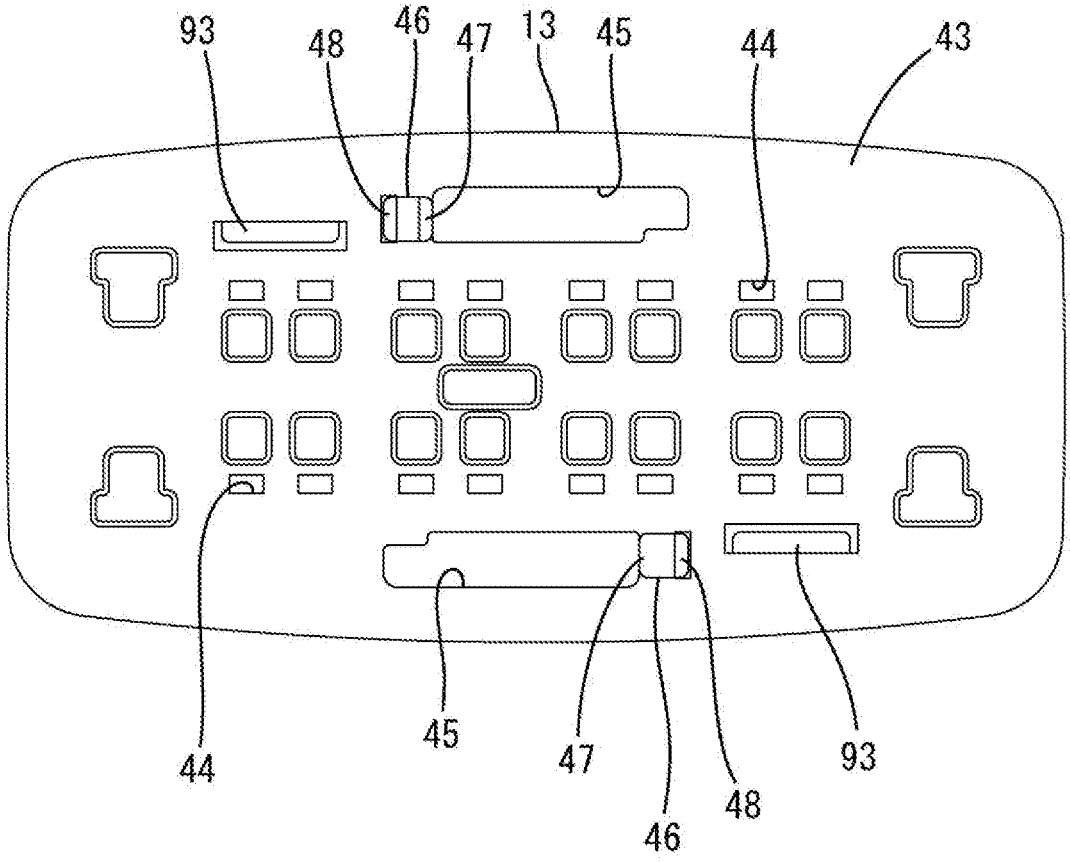
FIG. 11 is a front view of the moving plate.
Figure 12:
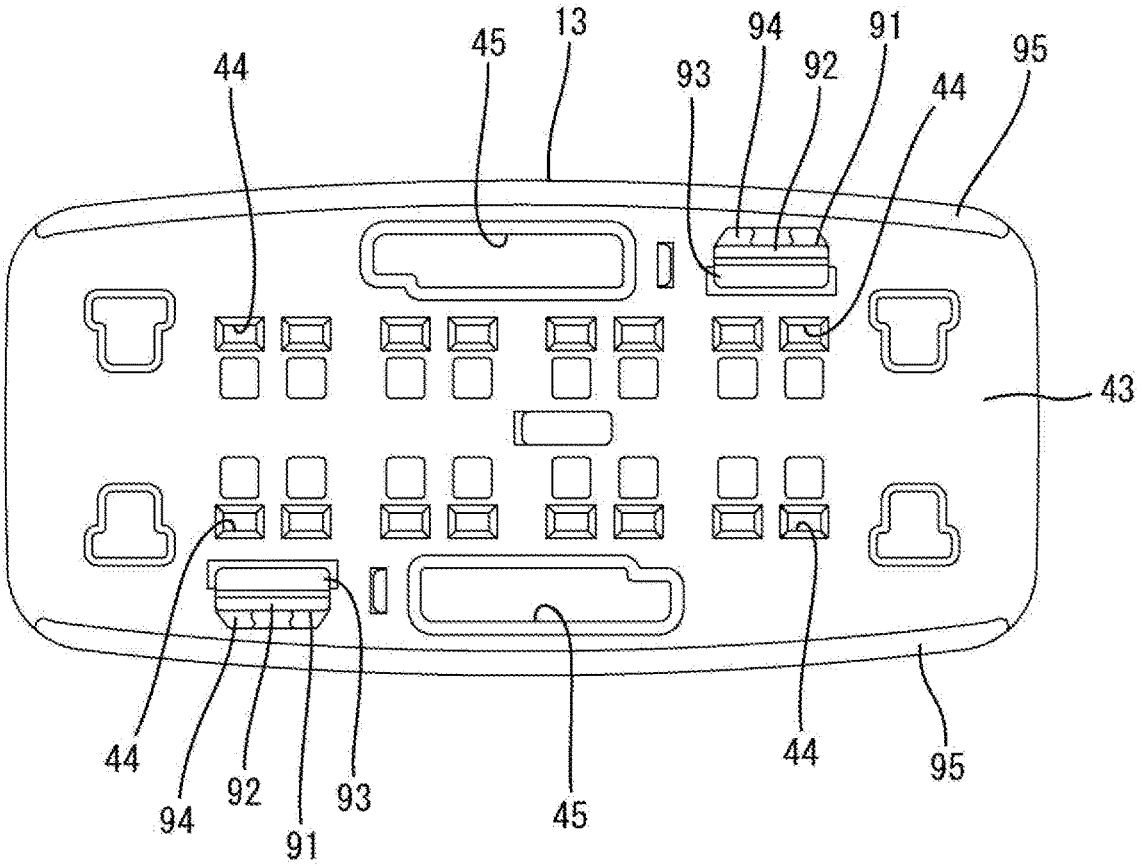
FIG. 12 is a back view of the moving plate.

As shown in FIGS. 10 to 12, the plate body 43 includes positioning holes 44 at positions corresponding to the respective cavities 32. As shown in FIG. 4, the tab 51 of the terminal fitting 50 is inserted into the positioning hole 44 while being positioned radially. Further, as shown in FIGS. 10 to 12, the plate body 43 has two through holes 45 on upper and lower sides across an area where the respective positioning holes 44 are arranged and in a laterally central part. Each through hole 45 is a laterally elongated opening and, as shown in FIG. 2, the prying preventing portion 26 is inserted therein while being radially positioned.

As shown in FIGS. 10 and 11, the plate body 43 includes two resilient locking pieces 46 on upper and lower parts of a front surface. The resilient locking pieces 46 are arranged at two diagonal positions centered on a central part of the front surface of the moving plate 13. The upper resilient locking piece 46 is adjacent one lateral side (shown left side) of the upper through hole 45 in the front surface of the plate body 43, and the lower resilient locking piece 46 is adjacent the other lateral side (shown right side) of the lower through hole 45 in the front surface of the plate body 43.

Each resilient locking piece 46 includes a resilient body 47 in the form of a rectangular column projecting forward from the front surface of the plate body 43 and a claw-like locking projection 48 projecting laterally away from the through hole 45 from a front tip of the resilient body 47. The resilient body 47 is deflectable in the lateral direction with a base end connected to the front surface of the plate body 43 as a support.

A vertical thickness of the resilient body 47 is slightly less than that of the prying preventing portion 26. As shown in FIG. 2, the resilient body 47 has a flat restricted surface 49 extending along the front-rear and vertical directions on a side opposite a side toward which the locking projection 48 projects and facing the through hole 45. The restricted surface 49 of the resilient body 47 is arranged to contact the restricting surface 28 of the prying preventing portion 26 along the front-rear direction to restrict deflection of the resilient locking piece 46.

Figure 3:
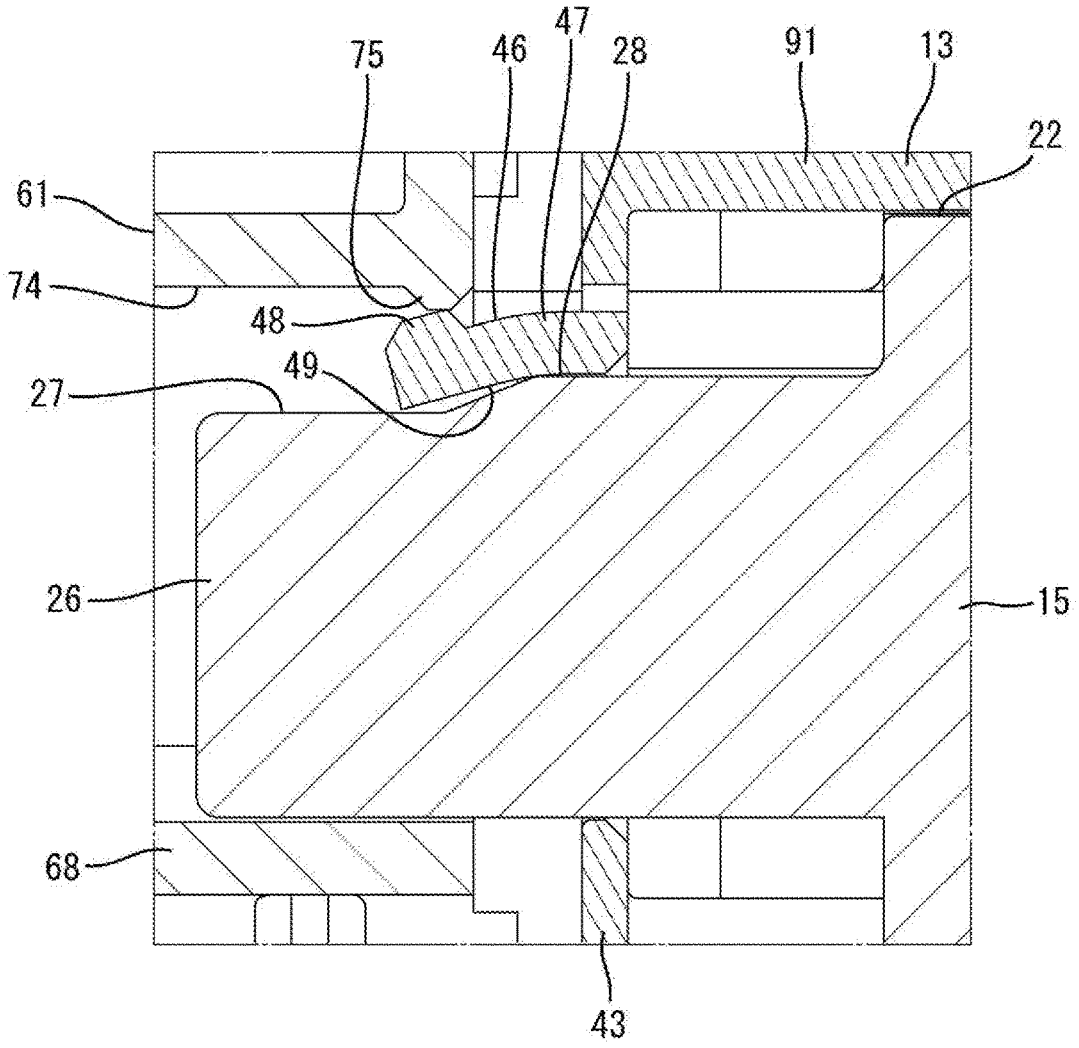
FIG. 3 is an enlarged section showing a state where a resilient locking piece is deflected and deformed in the process of connecting/separating a connector.

The projecting end surface of the locking projection 48 is flat in the front-rear direction. The front and rear surfaces of the locking projection 48 are inclined to taper the locking projection 48 toward the projecting end surface. After the resilient body 47 is deflected, the rear surface of the locking projection 48 faces the rear surface (rear surface viewed from the side of the mating connector body 61) of the receiving portion 75 so that the resilient locking piece 46 is locked to the receiving portion 75 (see FIGS. 3 and 6).

As shown in FIG. 12, the plate body 43 includes partial locking portions 91 on both upper and lower end parts of the rear surface. The respective partial locking portions 91 are arranged at two diagonal positions centered on a central part of the rear surface of the moving plate 13. The upper partial locking portion 91 is separated slightly toward one lateral side (shown right side) from the upper through hole 45 in the rear surface of the plate body 43, and the lower partial locking portion 91 is separated slightly toward the other lateral side (shown left side) from the lower through hole 45 in the rear surface of the plate body 43. The resilient locking pieces 46 and the partial locking portions 91 are arranged on the same lateral sides on the front and rear surfaces of the moving plate 13.

Figure 7:
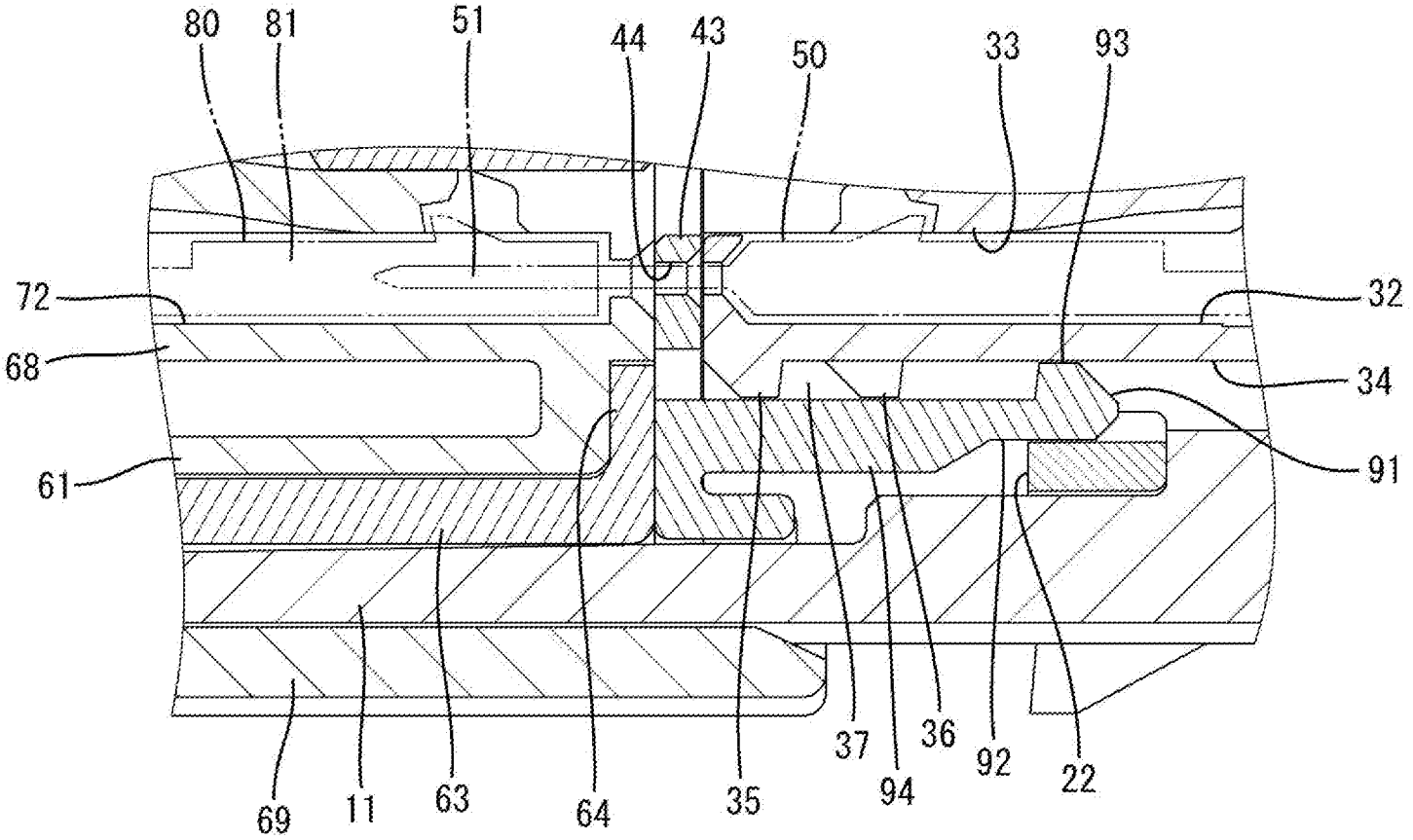
FIG. 7 is an enlarged section showing a state where the partial locking portion is substantially in a natural state when the connector is properly connected.

As shown in FIGS. 4 and 7, the partial locking portion 91 includes a partial locking body 92 in the form of a plate projecting rearward from the rear surface of the plate body 43 and an interfering projection 93 projecting in toward a vertical center of the plate body 43 from a rear end of the partial locking body 92. The partial locking body 92 is deflectable vertically in the plate thickness direction of the partial locking body 92 with a base end connected to the rear surface of the plate body 43 as a support. As shown in FIG. 10, a padded reinforcing portion 94 is provided on the base end of the partial locking body 92.

As shown in FIG. 12, the interfering projection 93 is a rib extending in the lateral direction over substantially the entire width of the partial locking body 92. As shown in FIGS. 4 and 7, the projecting end surface of the interfering projection 93 is flat in the front-rear direction. The front surface of the interfering projection 93 is substantially vertically upright and the rear surface is inclined forward. A lateral projecting dimension of the interfering projection 93 is larger than a lateral projecting dimension of the locking projection 48 of the resilient locking piece 46.

Guide walls 95 project slightly rearward from upper and lower end parts of the outer periphery of the plate body 43 of the moving plate 13, as shown in FIG. 10. The guide walls 95 cover the upper and lower surfaces of a front end of the peripheral wall 17 and are arranged such that their rear ends can contact the stoppers 25 at the connection position.

<Assembling Operation of Moving Plate 13>

The moving plate 13 is inserted into the receptacle 11 from the front and held at the partial locking position with respect to the housing 14 (see FIG. 1). At the partial locking position, the partial locking portions 91 enter the corresponding recesses 34 of the housing body 29 via the cutouts 22 of the peripheral wall 17, and the interfering projections 93 are fit into the movement restricting spaces 37. At this time, the front surfaces of the interfering projections 93 face in a manner to be able to contact the rear surfaces of the first interfering portions 35, thereby restricting forward escape of the moving plate 13 from the receptacle 11. Further, rear surfaces of the interfering projections 93 obliquely face in a manner to be able to contact the front surfaces of the second interfering portions 36, thereby restricting a drop of the moving plate 13 to the back of the receptacle 11 (toward the connection position).

Before the moving plate 13 is held at the partial locking position, the front retainer 15 is in a state properly mounted in the housing 14. When the moving plate 13 is at the partial locking position, the prying preventing portions 26 of the front retainer 15 are in the through holes 45 of the plate body 43 (see FIG. 2). At this time, the resilient locking pieces 46 face the escaping recesses 27 of the prying preventing portions 26 except at the base ends, and the resilient bodies 47 are deflectable and deformable toward the escaping recesses 27.

With the terminal fittings 50 properly inserted in the cavities 32 of the housing body 29, the tabs 51 project into the receptacle 11 (see FIG. 1). When the moving plate 13 is at the partial locking position, tips of the tabs 51 of the terminal fittings 50 are positioned and inserted into the positioning holes 44 and protected by the moving plate 13.

<Connecting Operation of Both Connectors 10, 60>

In the above state, the mating connector body 61 is inserted into the receptacle 11. When the mating connector body 61 approaches the plate body 43 of the moving plate 13, the prying preventing portions 26 enter the recesses 74 via the through holes 66 and the resilient locking pieces 46 arranged adjacent to the prying preventing portions 26 also enter the recesses 74 via the through holes 66. When the resilient locking pieces 46 enter the recesses 74, the locking projections 48 slide from the front surfaces (front surfaces viewed from the side of the mating connector body 61) to the projecting end surfaces of the receiving portions 75 and the resilient bodies 47 (parts excluding the base end sides) are deflected and deformed into the escaping recesses 27 of the prying preventing portions 26 (see FIG. 3).

Figure 5:
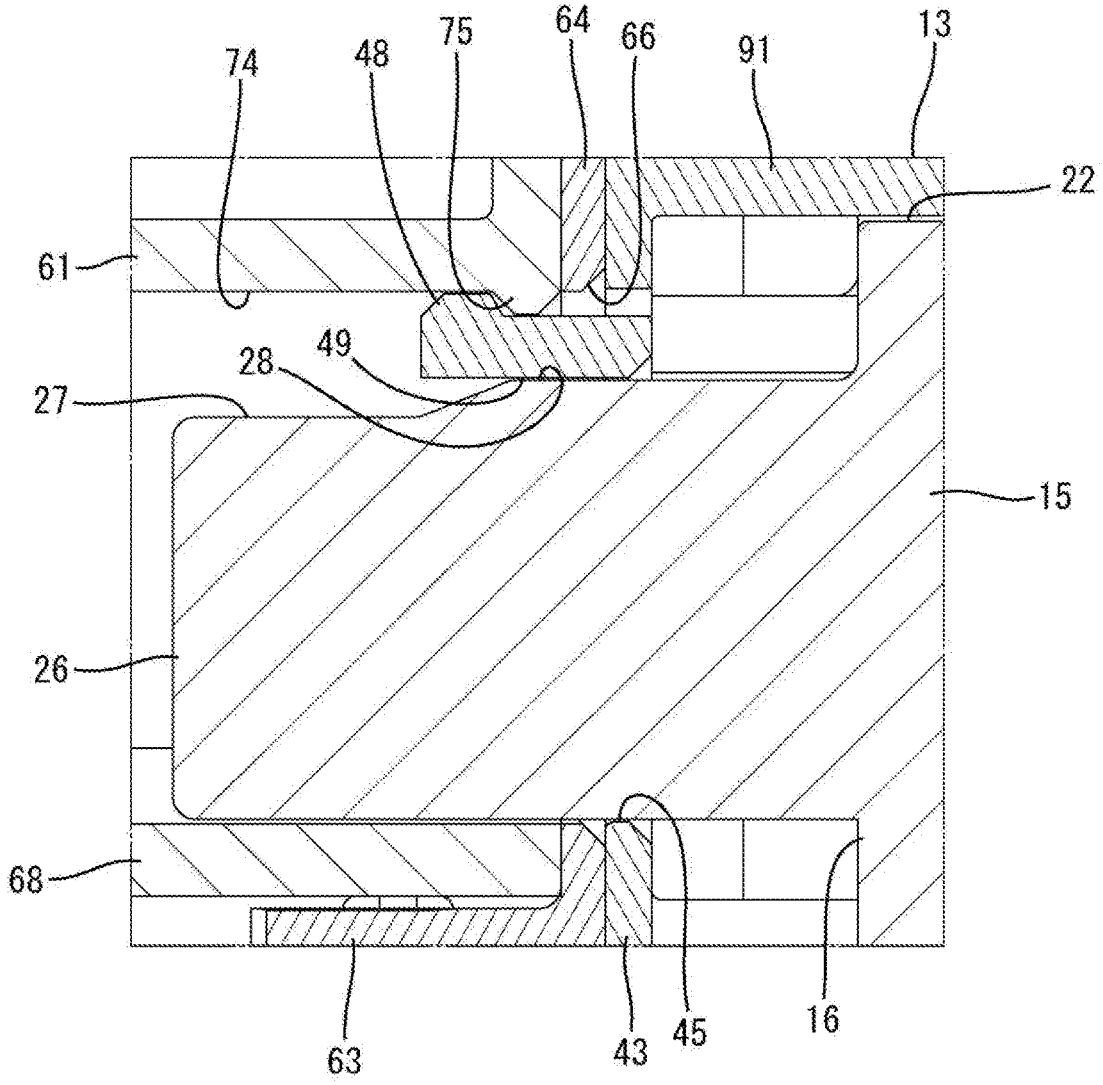
FIG. 5 is an enlarged section showing a state where the deflection of the resilient locking piece is restricted by a restricting surface in the stage of FIG. 4.

When the mating connector body 61 is inserted farther into the receptacle 11 and the mating front wall 64 of the mating front retainer 63 reaches a position to contact the plate body 43 of the moving plate 13, the resilient bodies 47 resiliently return to the natural state and the locking projections 48 face the rear surfaces of the receiving portions 75 (see FIG. 5). Thus, when the mating connector body 61 is displaced in a direction to be separated from the receptacle 11, the resilient locking pieces 46 are locked to the receiving portions 75 and the locking state therebetween is maintained. As a result, the moving plate 13 is in a state displaceable in a separating direction together with the mating connector body 61.

When the mating connector body 61 is inserted farther into the receptacle 11 and a pressing force acting on the moving plate 13 from the mating connector body 61 is enhanced, the interfering projections 93 of the partial locking portions 91 slide from the front surfaces to the projecting end surfaces of the second interfering portions 36 and the partial locking bodies 92 are deflected and deformed (see FIG. 4). In this way, a partial locking state between the partial locking portions 91 and the second interfering portions 36 is released.

When the moving plate 31 is pressed by the mating connector body 61 and the plate body 43 moves toward the back of the receptacle 11 (toward the connection position), the partial locking bodies 92 resiliently return toward a natural state. Then, the interfering projecting portions 93 move over the second interfering portions 36 and can escape into spaces in rear parts of the recesses 34. Until the moving plate 13 moves to the connection position, the interfering projections 93 are in the spaces in the rear parts of the recesses 34 to maintain the state where locking between the partial locking portions 91 and the second interfering portions 36 is released (see FIG. 7).

When the moving plate 13 moves toward the connection position, the prying preventing portions 26 are inserted gradually farther into the recesses 74 (successively see FIGS. 2, 3, 5 and 6) and the resilient locking pieces 46 are displaced to retreat with respect to the corresponding prying preventing portions 26. Thus, areas where the restricting surfaces 28 of the prying preventing portions 26 overlap the restricted surfaces 49 of the resilient bodies 47 of the corresponding resilient locking pieces 46 become gradually larger.

When the mating connector body 61 is inserted properly into the receptacle 11, the lock arm 71 resiliently locks the lock 31, and the plate body 43 contacts the front wall 16 of the front retainer 15 and is sandwiched between the connector body 12 and the mating connector body 61 (see FIG. 7). In this way, the connectors 10, 60 are connected properly and the tabs 51 of the terminal fittings 50 are inserted into the boxes 81 of the mating terminal fittings 80 through the positioning holes 44 and the terminal fittings 50, 80 are connected electrically.

Figure 6:
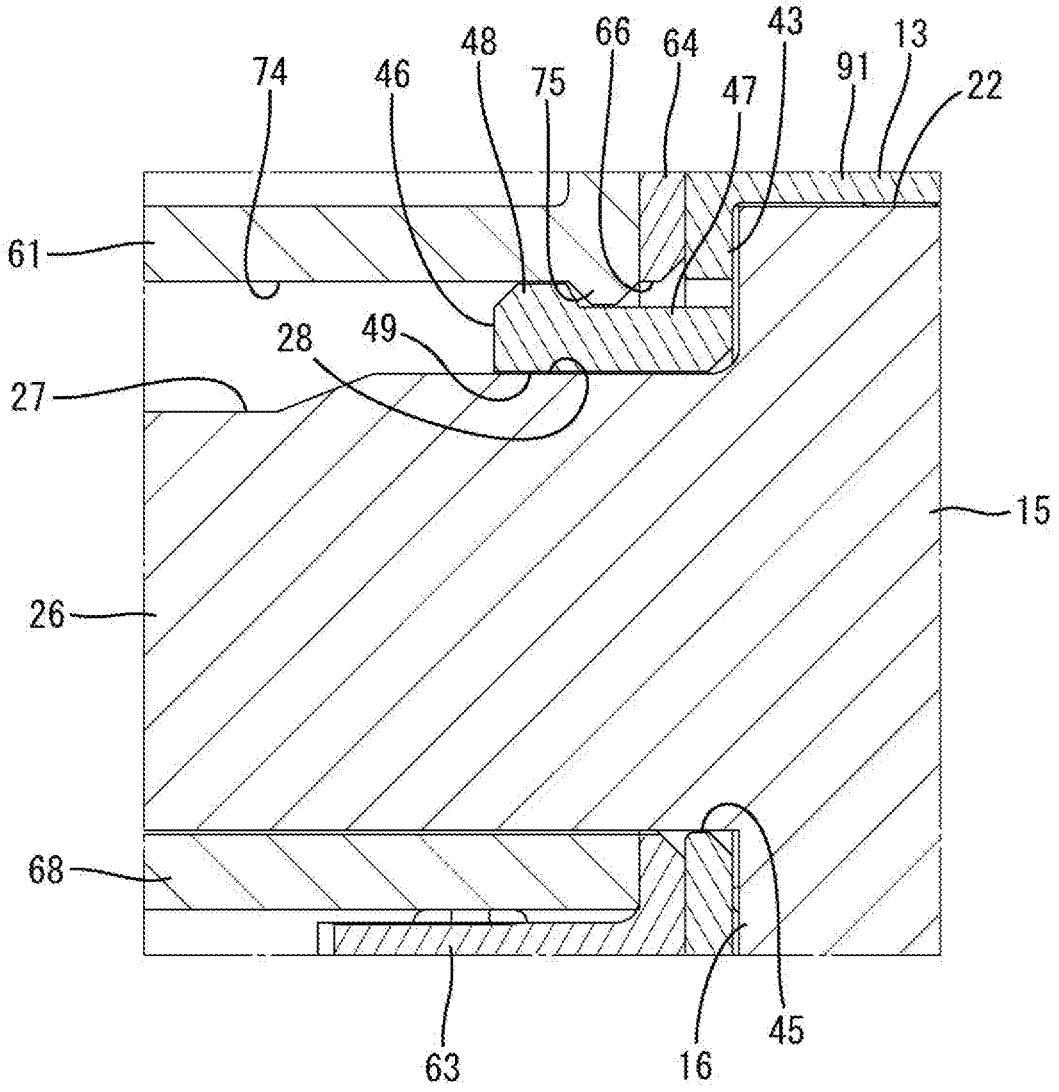
FIG. 6 is an enlarged section showing a state where the deflection of the resilient locking piece is restricted by the restricting surface when the connector is properly connected.

At this time, the prying preventing portions 26 are inserted deep into the recesses 74, and the escaping recesses 27 of the prying preventing portions 26 are spaced forward of the resilient locking pieces 46 (see FIG. 6). The restricting surfaces 28 of the prying preventing portions 26 face in such a manner as to be able to come contact the restricted surfaces 49 of the resilient bodies 47 of the resilient locking pieces 46 to cover the entire restricted surfaces 49. In this way, deflection of the resilient locking pieces 46 is reliably restricted.

If an attempt is made to insert the mating connector body 61 into the receptacle 11 in a posture inclined from a proper insertion posture along the front-rear direction, the mating connector body 61 contacts the prying preventing portions 26. Thus, contact of the mating connector body 61 with the tips of the tabs 51 of the terminal fittings 50 can be avoided and a situation where the tabs 51 are pried can be prevented.

<Separating Operation of Both Connectors 10, 60>

In separating the both connectors 10, 60 for maintenance or other reason, the lock arm 71 and the lock portion 31 are unlocked first and, in that state, the mating connector body 61 is pulled rearward (rearward when viewed from the mating connector body 61) to be separated from the front wall 16. In an initial stage where the mating connector body 61 retreats (retreats when viewed from the mating connector body 61), the restricted surfaces 49 of the resilient bodies 47 of the resilient locking pieces 46 face the restricting surfaces 28 of the prying preventing portions 26 to restrict deflection of the resilient locking pieces 46, and the locking state between the locking projections 48 of the resilient locking pieces 46 and the receiving portions 75 is maintained. Thus, the moving plate 13 moves in a direction to return to an initial position together with the mating connector body 61.

Further, in the initial stage where the mating connector body 61 retreats, the interfering projections 93 of the partial locking portions 91 are located in the recesses 34 and separated rearward from the second interfering portions 36. Therefore, resistance due to the interference of the partial locking portions 91 and the second interfering portions 36 is not generated (see FIG. 7). Note that, when the connectors 10, 60 are connected, the tips of the partial locking portions 91 ride on the outer surface of the peripheral wall 18 behind the cutouts 22 to restrict the deflection of the partial locking portions 91.

In a final stage where the mating connector body 61 retreats, the front surfaces of the interfering projections 93 and the rear surfaces of the second interfering portions 36 engage along the vertical direction (perpendicular to a moving direction of the moving plate 13) and resistance for restricting a movement to the initial position is generated in the moving plate 13 due to interference of the interfering projections 93 and the second interfering portions 36.

When the interfering projections 93 ride on the projecting end surfaces of the second interfering portions 36 in this way and a riding amount exhibits a maximum value, the partial locking bodies 92 of the partial locking portions 91 are deflected and deformed maximally and resistance becomes largest (see FIG. 4). At this time, parts of the restricted surfaces 49 of the resilient bodies 47 face in such a manner as to be able to contact the restricting surfaces 28 of the prying preventing portions 26 (see FIG. 5). Specifically, tips of the restricted surfaces 49 of the resilient bodies 47 are facing the escaping recesses 27 of the prying preventing portions 26, but the base ends and areas slightly closer to the tips than the base end sides are facing the restricting surfaces 28 of the prying preventing portions 26. As just described, the areas of the restricted surfaces 49 of the resilient bodies 47 from the base ends to parts closer to the tips are facing the restricting surfaces 28 of the prying preventing portions 26. Thus, the restricting surfaces 28 restrict deflection of the resilient bodies 47. Additionally, when the interfering projecting portions 93 ride on the projecting end surfaces of the second interfering portions 36 and the riding amount exhibits the maximum value, the locking state between the locking projections 48 of the resilient locking pieces 46 and the receiving portions 75 is maintained and the state where the moving plate 13 moves together with the mating connector body 61 continues.

When the mating connector body 61 further retreats and the moving plate 13 returns to the initial position, the partial locking bodies 92 resiliently return substantially to the natural state and the interfering projecting portions 93 are fit into the movement restricting spaces 37 (see FIG. 1). If a pulling force is applied in a direction to separate the mating connector body 61 from the receptacle 11 in that state, the interfering projections 93 contact the first interfering portions 35 to restrict any further movement of the moving plate 13. At this time, only base ends of the restricted surfaces 49 of the resilient bodies 47 face the restricting surfaces 28 of the prying preventing portions 26 and most parts including the tips face the escaping recesses 27 of the prying preventing portions 26 (see FIG. 2). Thus, when the mating connector body 61 is separated from the receptacle 11, the resilient bodies 47 are deflected and deformed into the escaping recesses 27 (see FIG. 3), the locking projections 48 are disengaged from the receiving portions 75 and the locking state between the resilient locking pieces 46 and the receiving portions 75 is released. When the mating connector body 61 is separated from the receptacle 11 in this way, the moving plate 13 is separated from the mating connector body 61 and held at the initial position.

<Functions and Effects>

According to this embodiment, in the process of separating the mating connector body 61 from the receptacle 11, the interfering projecting portions 93 of the partial locking portions 91 ride on the second interfering portions 36 and the deflection of the resilient bodies 47 of the resilient locking pieces 46 is restricted by the restricting surfaces 28 of the prying preventing portions 26 of the connector body 12 until the riding amount of the partial locking portions 91 exhibits the maximum value. Thus, the locking state between the resilient locking pieces 46 and the receiving portions 75 is maintained and the return of the moving plate 13 to the initial position is ensured.

In this case, even if locking margins when the locking projections 48 of the resilient locking pieces 46 lock the receiving portions 75 are not made larger, restricting forces of the restricting surfaces 28 can overcome resistance when the interfering projections 93 of the partial locking portions 91 ride on the second interfering portions 36 and the locking state between the resilient locking pieces 46 and the receiving portions 75 can be maintained. Thus, projecting dimensions of the locking projections 48 of the resilient locking pieces 46 can be made sufficiently small and projecting dimensions of the receiving portions 75 can also be made smaller. As a result, enlargement can be suppressed and a degree of freedom in design can be enhanced. Although the receiving portions 75 are provided on the inner surfaces of the recesses 74 of the mating connector body 61 and the resilient locking pieces 46 enter the recesses 74 together with the prying preventing portions 26, opening diameters of the recesses 74 can be made small since the projecting dimensions of the locking projections 48 are small and, accordingly, structural restrictions around the recesses 74 in the mating connector body 61 can be reduced.

Further, since the restricting surfaces 28 are provided on the prying preventing portions 26, the restricting surfaces 28 need not be dedicated structures and the structure can be simplified. In addition, since the prying preventing portions 26 are provided on the front retainer 15, a function of preventing the prying of the tabs 51, a function of restricting the deflection of the resilient locking pieces 46 and a function of retaining the terminal fittings 50 can be consolidated on the front retainer 15 and, accordingly, structural restrictions of the housing 14 can be reduced.

Other embodiments are briefly described below.

The connector body may be composed only of the housing without including the front retainer. In this case, the prying preventing portions may be provided on the housing.

The restricting surfaces may be provided on parts of the connector body other than the prying preventing portions.

Contrary to the above embodiment, the second interfering portions may be deflected and deformed and the partial locking portions may be fixedly provided on the moving plate.

LIST OF REFERENCE SIGNS

10 . . . male connector
11 . . . receptacle
12 . . . connector body
13 . . . moving plate
14 . . . housing
15 . . . front retainer
21 . . . projecting piece

26 . . . prying preventing portion
28 . . . restricting surface
32 . . . cavity
33 . . . locking lance
35 . . . first interfering portion
36 . . . second interfering portion
46 . . . resilient locking piece
49 . . . restricted surface
50 . . . terminal fitting
51 . . . tab
60 . . . female connector (mating connector)
74 . . . recess
75 . . . receiving portion
91 . . . partial locking portion

What is claimed is:

1. A connector, comprising:

a connector body including a receptacle;

a terminal fitting including a tab projecting into the receptacle; and a moving plate movable between a partial locking position and a connection position backward of the partial locking position with the moving plate inserted in the receptacle and the tab positioned;

the moving plate including a partial locking portion configured to restrict a movement of the moving plate to the connection position by interfering with an interfering portion of the connector body at the partial locking position and move over the interfering portion when the moving plate returns from the connection position to the partial locking portion, and a resilient locking piece configured to be locked to a receiving portion of a mating connector, allow a movement from the connection position to the partial locking position by being kept locked to the receiving portion in the process of separating the mating connector from the receptacle and release locking to the receiving portion by being deflected and deformed when the mating connector is completely separated from the receptacle; and the connector body having a restricting surface configured to restrict the deflection of the resilient locking piece until a riding amount of the partial locking portion on the interfering portion exhibits a maximum value when the moving plate returns from the connection position to the partial locking position.

2. The connector of claim 1, wherein:

the connector body includes a prying preventing portion configured to prevent the prying of the tab by projecting into the receptacle from a back surface of the receptacle; and the restricting surface is provided on the prying preventing portion.

3. The connector of claim 2, wherein:

the mating connector includes a recess configured to receive the prying preventing portion; and the receiving portion is provided on an inner surface of the recess.

4. The connector of claim 3, wherein:

the connector body includes a housing having the receptacle and a front retainer configured to cover a front surface of the housing by being mounted into the housing;

the housing includes a cavity into which the terminal fitting is insertable, and a deflectable and deformable locking lance projecting into the cavity and configured to retain the terminal fitting; and the front retainer includes a projecting piece configured to restrict deflection of the locking lance on a rear surface and the prying preventing portion on a front surface side.

5. The connector of claim 2, wherein:

the connector body includes a housing having the receptacle and a front retainer configured to cover a front surface of the housing by being mounted into the housing;

the housing includes a cavity into which the terminal fitting is insertable, and a deflectable and deformable locking lance projecting into the cavity and configured to retain the terminal fitting; and the front retainer includes a projecting piece configured to restrict deflection of the locking lance on a rear end and the prying preventing portion on a front end.

* * * * *